US007942107B2

(12) United States Patent
Vosburgh

(10) Patent No.: US 7,942,107 B2
(45) Date of Patent: May 17, 2011

(54) DELIVERY SYSTEMS FOR PRESSURE PROTECTING AND DELIVERING A SUBMERGED PAYLOAD AND METHODS FOR USING THE SAME

(75) Inventor: Frederick Vosburgh, Durham, NC (US)

(73) Assignee: iRobot Corporation, Bedford, MA (US)

( * ) Notice: Subject to any disclaimer, the term of this patent is extended or adjusted under 35 U.S.C. 154(b) by 3 days.

(21) Appl. No.: 12/332,734

(22) Filed: Dec. 11, 2008

(65) Prior Publication Data

US 2011/0088609 A1 Apr. 21, 2011

Related U.S. Application Data

(60) Provisional application No. 61/013,184, filed on Dec. 12, 2007.

(51) Int. Cl.
*B63G 8/28* (2006.01)

(52) U.S. Cl. ..... 114/319; 114/312; 114/321

(58) Field of Classification Search ..... 114/238, 114/257, 312, 313, 316, 319, 321
See application file for complete search history.

(56) References Cited

U.S. PATENT DOCUMENTS

| | | | | |
|---|---|---|---|---|
| 4,189,786 | A | 2/1980 | Adler | |
| 5,666,900 | A * | 9/1997 | Carroll et al. | 114/316 |
| 5,918,307 | A * | 6/1999 | Cipolla | 114/238 |
| 6,058,071 | A | 5/2000 | Woodall et al. | |
| 6,254,445 | B1 | 7/2001 | Jones | |
| 6,484,618 | B1 * | 11/2002 | Dubois | 114/22 |
| 6,701,819 | B1 * | 3/2004 | Williams et al. | 114/316 |
| 6,711,095 | B1 | 3/2004 | Daniels | |
| 6,738,314 | B1 | 5/2004 | Teeter et al. | |
| 6,813,218 | B1 | 11/2004 | Antonelli et al. | |
| 6,899,583 | B2 | 5/2005 | Barden | |
| 6,961,657 | B1 | 11/2005 | Wernli et al. | |
| 7,032,530 | B1 * | 4/2006 | Ansay et al. | 114/319 |
| 7,140,289 | B1 * | 11/2006 | Ansay et al. | 114/319 |
| 7,496,000 | B2 | 2/2009 | Vosburgh et al. | |
| 7,496,002 | B2 | 2/2009 | Vosburgh | |

* cited by examiner

*Primary Examiner* — Lars A Olson
(74) *Attorney, Agent, or Firm* — Myers Bigel Sibley & Sajovec, PA

(57) ABSTRACT

A payload delivery system for protecting and delivering a payload submerged in a submersion medium includes a containment system. The containment system includes a container and a dehiscing system. The container includes a pressure-resistant shell defining a sealed containment chamber. The dehiscing system is operative to dehisce the shell to open the containment chamber to the submersion medium responsive to a prescribed event and/or a prescribed environmental condition.

33 Claims, 7 Drawing Sheets

DELIVERY SYSTEMS FOR PRESSURE PROTECTING AND DELIVERING A SUBMERGED PAYLOAD AND METHODS FOR USING THE SAME

RELATED APPLICATION(S)

This application claims the benefit of and priority from U.S. Provisional Patent Application Ser. No. 61/013,184, filed Dec. 12, 2007.

STATEMENT OF GOVERNMENT SUPPORT

This invention was made with support under Small Business Innovation Research (SBIR) Program No. N00014-07-C-0197 awarded by the United States Navy Office of Naval Research. The Government has certain rights in the invention.

FIELD OF THE INVENTION

The present invention relates to submersible devices and, more particularly, to systems for protecting and delivering submersible payloads.

BACKGROUND OF THE INVENTION

Monitoring littoral seas without being detected can be desirable in times of conflict. In such cases, autonomous submersible monitoring and communications systems can provide much needed intelligence. While such devices can be deployed without detection, communicating the results of monitoring by devices submerged in the sea is problematic. Sonar provides low bandwidth over short ranges and radio communications, at all but the highest powers and lowest data rates, are blocked by salt water. Effective communication requires therefore that an antenna be raised above the sea. A variety of systems have been described for raising an antenna above the sea, but they are either expensive, impractical, or readily detected, making them unsuitable for exporting information without being detected.

SUMMARY OF THE INVENTION

According to embodiments of the present invention, a payload delivery system for protecting and delivering a payload submerged in a submersion medium includes a containment system. The containment system includes a container and a dehiscing system. The container includes a pressure-resistant shell defining a sealed containment chamber. The dehiscing system is operative to dehisce the shell to open the containment chamber to the submersion medium responsive to a prescribed event and/or a prescribed environmental condition.

According to method embodiments of the present invention, a method for protecting and delivering a payload submerged in a submersion medium includes providing a containment system including: a container including a pressure-resistant shell defining a sealed containment chamber; and a dehiscing system. The method further includes: mounting the payload in the containment chamber; submerging the container with the payload mounted in the containment chamber; and thereafter dehiscing the shell using the dehiscing system to open the containment chamber to the submersion medium responsive to a prescribed event and/or a prescribed environmental condition.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
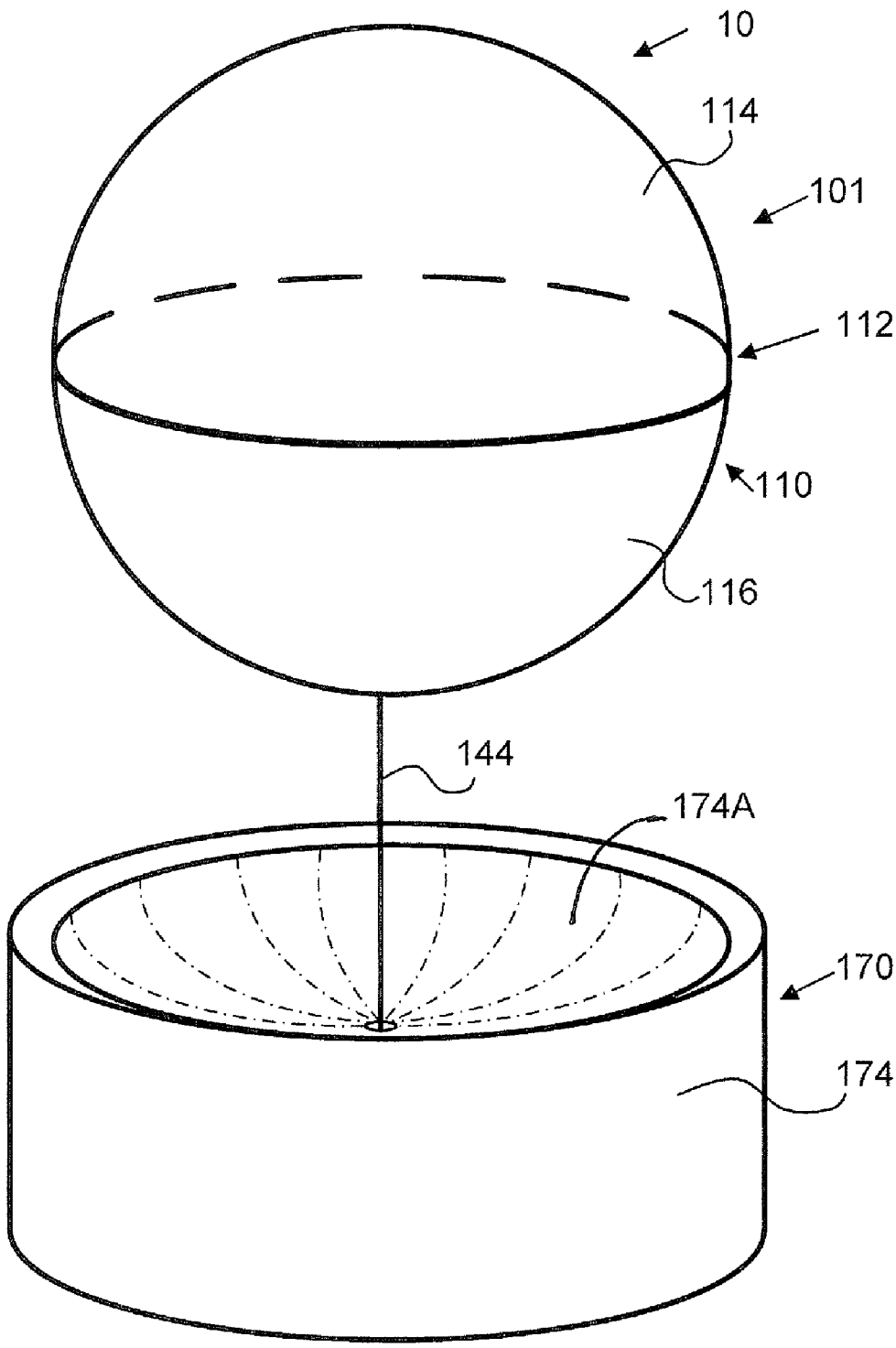
FIG. 1 is a perspective view of a payload delivery system according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "dehisce" means that a component or components are separated or burst open to expose a previously enclosed chamber or volume.

With reference to FIGS. 1-5B, a payload delivery system 10 according to embodiments of the present invention is shown therein. The payload delivery system 10 includes a pressure protective container system 100 and a payload or contents 150, such as operational contents. The container system 100 includes a container assembly or container 110 within which the payload 150 is housed and a dehiscing system 130 operable to dehisce or open the container assembly to release the payload 150 from the container 110. The dehiscing system 130 includes a dehiscence module 132. The container system 100 may further include a secondary object 170 such as a vehicle or a secondary object associated with the container 110 and/or the dehiscing system 130. The container 110, the dehiscence module 132, and the payload 150 together constitute a dispensable unit 101 that can be dispensed or released from the secondary object 170. The payload 150 may itself comprise a self-contained subunit that can be released from the container 110.

In general, the payload delivery system 10 can be deployed in a body of water W (FIGS. 5A and 5B) such that the container 110 (and the payload 150 therein) is submerged at a depth. The container 110 protects the payload 150 from water pressure at the depth and may thereby protect the payload 150 from damage that may otherwise occur to the payload 150 due to such water pressure. The container 110 may also protect the payload 150 from exposure to the water W at other than a desirable time or depth. Responsive to a prescribed event and/or a prescribed environmental condition, the dehiscing system 130 automatically dehisces the container 110 to thereby release the payload 150 from the container 110. The dehiscing system 130 may spontaneously open the container 110. The payload delivery system 10 can thus provide pressure protection for the payload 150 while also providing exposure of the payload 150 to the water at a desirable depth. For example, in some embodiments, the container 110 protects the payload 150 while at a first, relatively deeper depth and is forcibly or passively caused to open by the dehiscing system 130 when the container 110 rises to a second, relatively shallower depth. According to some embodiments, the payload delivery system 10 also automatically activates a device or function of the payload 150 before or as the payload 150 is released from the container 110. According to some embodiments, the container 110 is dehisced responsive to a prescribed event including at least one of elapse of a prescribed period of time, achievement or attainment of a prescribed depth, detection of a prescribed signal, receipt of a command, attainment of a prescribed location, and occurrence of a prescribed operational condition. According to some embodiments, the container 110 is dehisced when an externally imposed pressure on the container 110 (e.g., water pressure) becomes less than a prescribed threshold pressure. These and further aspects of the system 10 will now be described in further detail.

Figures 5A, 5B:
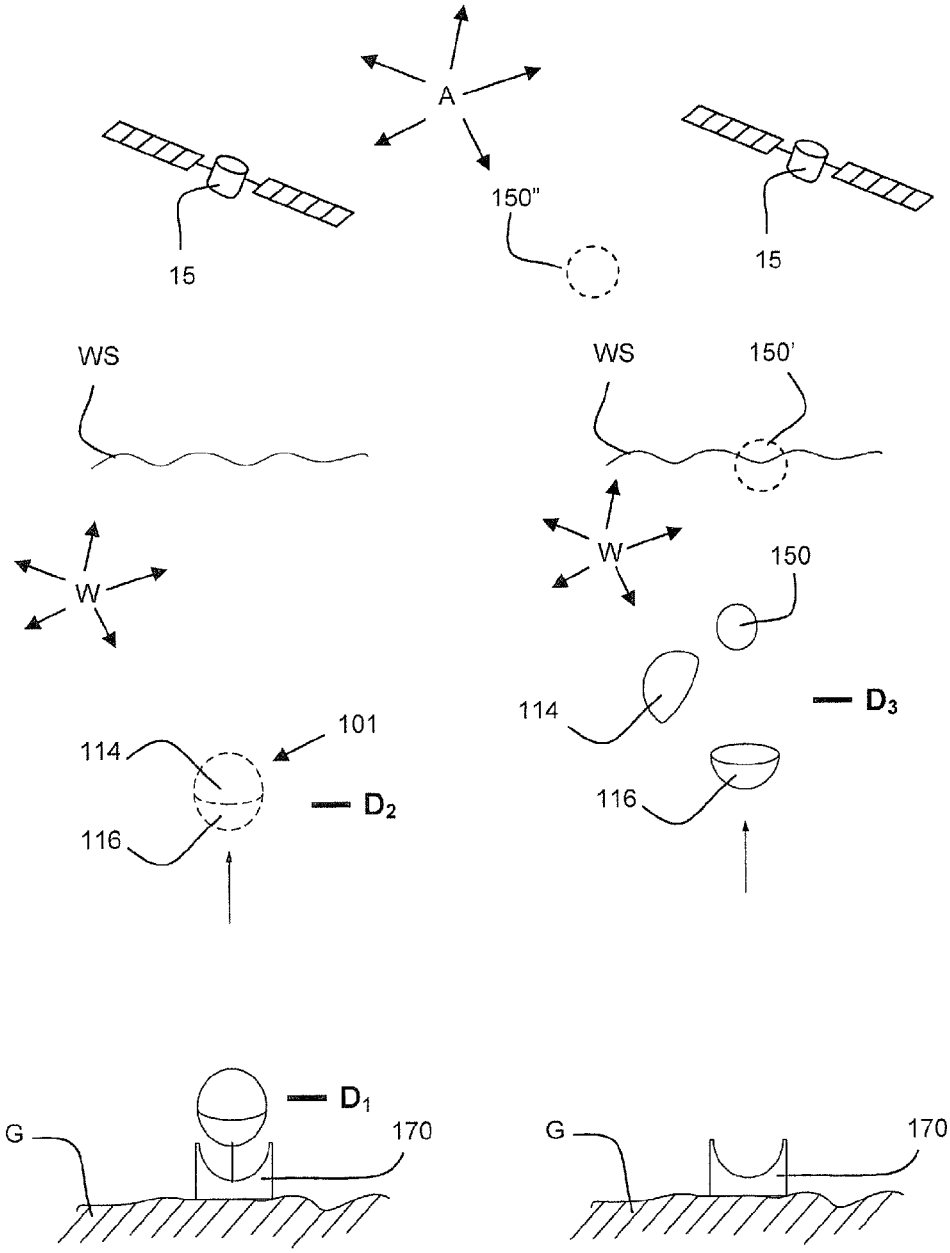
FIG. 5A is a schematic view of the payload delivery system of FIG. 1 wherein the dispensable unit is depicted at first and second depths in a body of water and not dehisced.
FIG. 5B is a schematic view of the payload delivery system of FIG. 1 wherein the dispensable unit is at a third depth in the water, the container is dehisced, and the payload is released into the water.

In some embodiments, the payload 150 is a communications device adapted or configured to communicate by sending signals to and/or by receiving signals from a remote device 15 (e.g., a satellite; FIGS. 5A and 5B) from a location proximate or on the surface WS of the water W (as indicated in FIG. 5B by the numeral 150') or from a location in the air A above the surface of the water (as indicated in FIG. 5B by the numeral 150"). Systems and methods of the present invention may be used for communications between a submerged object or location and a remote user. In some cases, the payload 150 is also configured as a sensing device for environmental, oceanographic, intelligence, surveillance, or reconnaissance uses, which sensing is conducted in air A or water W. In some embodiments, the payload 150 includes a communications device as disclosed in U.S. patent application Ser. No. 11/494,941 (published as U.S. Published Application No. 2008/0192576 A1), the disclosure of which is incorporated herein by reference.

Figure 2:
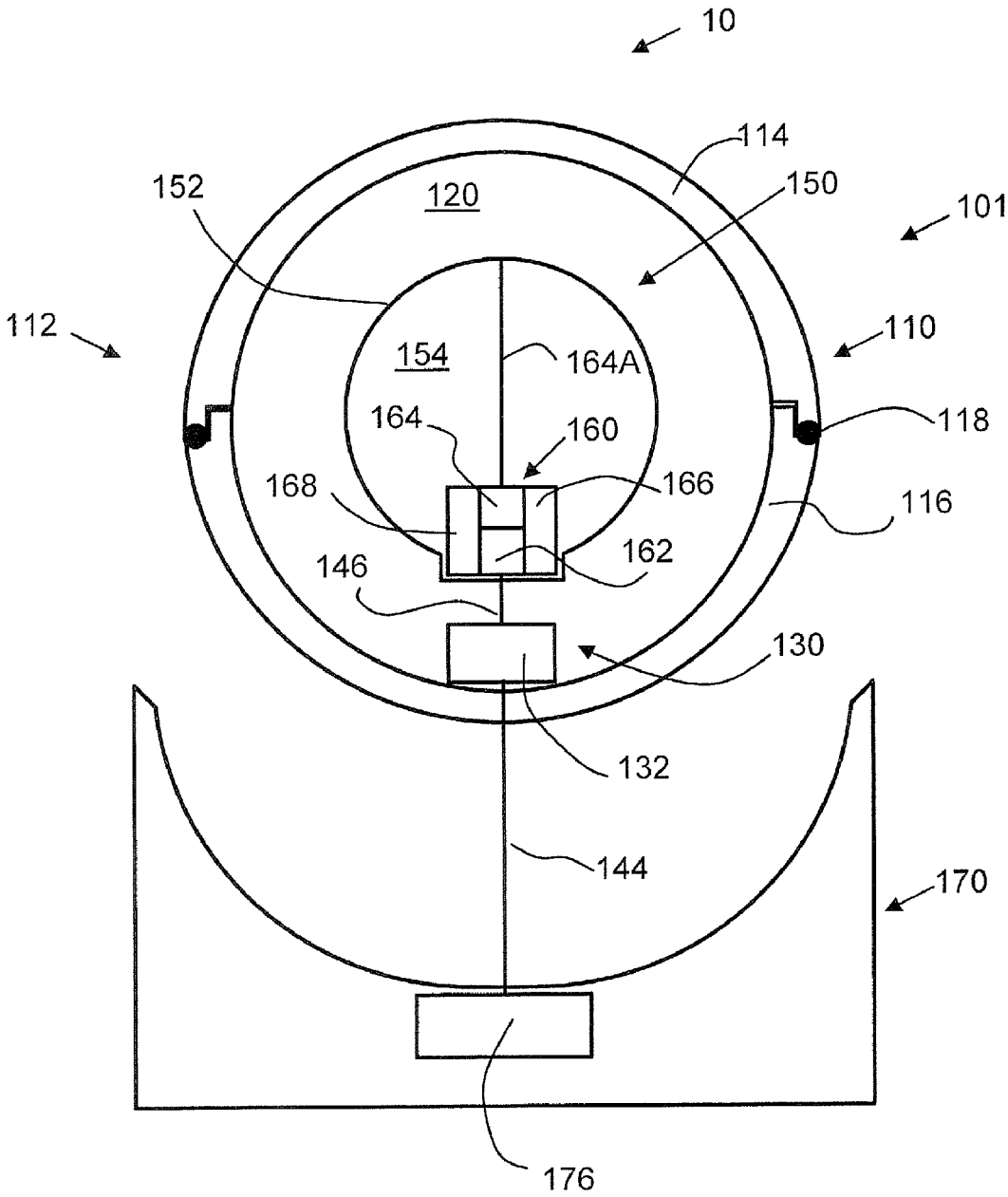
FIG. 2 is schematic, cross-sectional view of the payload delivery system of FIG. 1.
Figure 4:
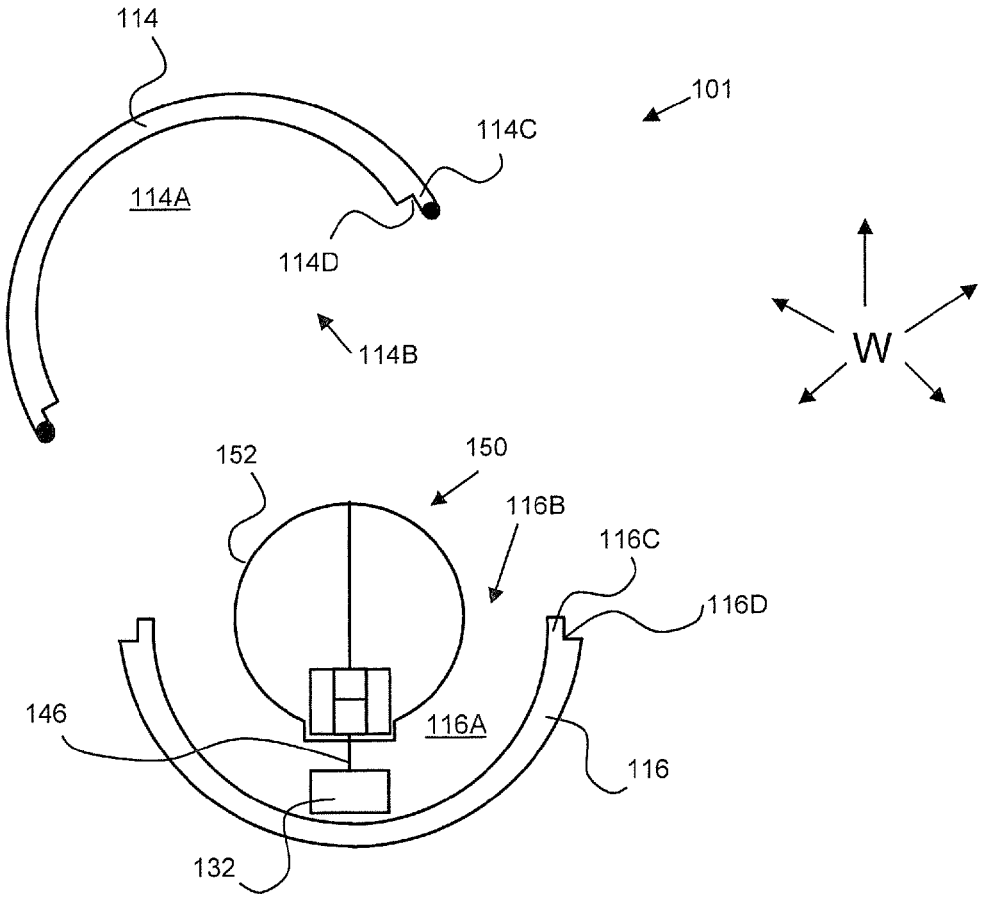
FIG. 4 is a schematic, cross-sectional view of a dispensable unit of the payload delivery system of FIG. 1 wherein a container thereof has been dehisced to expose a payload.

With reference to FIGS. 1, 2 and 4, the container 110 includes a shell 112. The shell 112 includes two or more substantially rigid shell members 114, 116. The shell members 114, 116 each have a respective perimeter face 114C, 116C (FIG. 4) defining an opening 114B, 116B (FIG. 4) communicating with a respective cavity 114A, 116A (FIG. 4). Perimeter grooves 114D and 116D (FIG. 4) are located in the faces 114C and 116C, which may serve as alignment features. The shell members 114, 116 are mated such that their perimeter faces 114C and 116C juxtapose or overlap and seat in the corresponding grooves 116D and 114D to form a face or, as illustrated, a lap joint. A seal member 118 such as an adhesive or compliant member (e.g., an elastomeric O-ring) may be interposed between the mating portions of the shell members 114, 116 to effect an improved water-resistant seal.

The shell members 114, 116 together define an interior containment chamber 120 of the shell 112. According to some embodiments, the payload 150 is substantially fully contained in the chamber 120. According to some embodiments, the shell 112 is water submersible so that water is prevented from contacting the payload 150 (or water-sensitive components thereof).

The shell 112 may be of any suitable size and shape. In some embodiments, the shell 112 is substantially spherical as shown and the shell members 114, 116 are hemispherical. According to some embodiments, the chamber 120 has a size in the range of from about 4 to 50 centimeters in diameter, which for a spherical shape corresponds to a volume in the range of from about 0.03 to 6.5 liters.

The shell 112 may be formed of any suitable material. According to some embodiments, the shell 112 is formed of a polymeric material such as Plexiglass, polycarbonate, glass or glass-filled polymer.

The shell 112 may have any suitable size and volume. In some embodiments, the volume of the shell 112 and the volume of the chamber 120 are selected to provide a desired buoyancy to thereby provide a desired rate of change in depth when permitted to float freely. The shell 112 may be sized so that it can rise buoyantly at a desirable rate from a deployment depth to a desirable release depth, such as one at which the payload is not damaged by water pressure and can be released.

Figure 3:
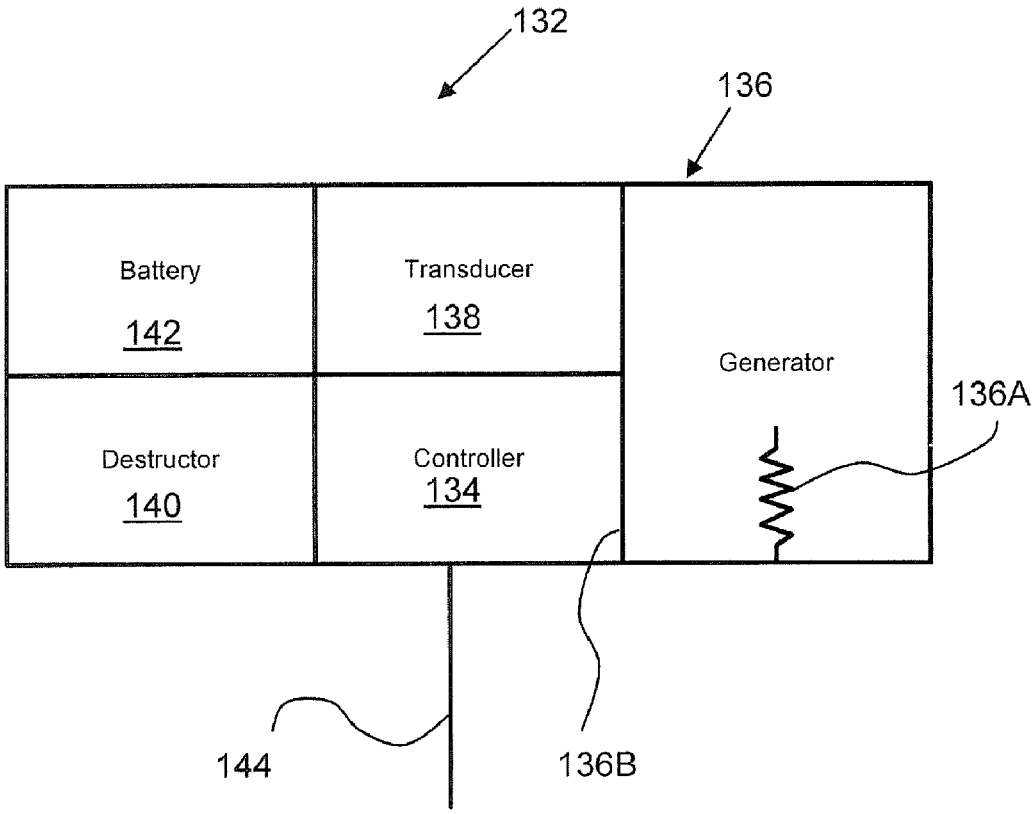
FIG. 3 is a schematic view of a dehiscence module of the payload delivery system of FIG. 1.

The dehiscing system 130 can operate using any suitable principle or mechanism to dehisce the shell 112 to release the payload 150. According to some embodiments, the dehiscing system 130 opens the shell 112 by generating an outward force or pressure. An exemplary dehiscing system 130 as illustrated in FIG. 3 includes a dehiscence module 132 and a link 144 between the dehiscence module 132 and the secondary object 170. The dehiscence module 132 includes a controller 134, a pressure generator 136, a transducer 138, a destructor 140, a battery 142, a link 144 (to the secondary object 170), and a link 146 (to the payload 150).

According to some embodiments, the dehiscing system 130 can provide an internal pressure acting outward against the shell 112 in the range of from about 0.001 to 100 atmospheres (gauge), corresponding to a range of depth in water of from about 1 cm to 1000 meters or more.

The controller 134 may be any suitable device or devices configured to enable the methods discussed herein. The controller 134 can be configured to provide operational control, to store signals, and/or to provide signals. The controller 134 may include a microprocessor. The controller 134 may execute, initiate and/or coordinate dehiscence of the shell 112, sensing of an event or parameter (e.g., an environmental condition), processing of sensed or received data, and/or communication with an external device. In some embodiments, the controller 134 is responsive to a processing result and/or a state of the shell 112 to initiate dehiscence of the shell 112.

The pressure generator 136 may be any suitable device capable of providing an increase in the internal pressure in the chamber 120 sufficient to dehisce the container 110. According to some embodiments, the pressure generator generates additional internal pressure in the chamber 120 by heating the volume of gas therein. According to some embodiments, the heated gas in the chamber is a fixed amount of gas.

According to some embodiments, the pressure generator 136 is a gas provider that can provide additional gas to the chamber 120 to increase the pressure in the chamber 120. The gas provider may provide additional gas by releasing a gas (e.g., compressed gas from a container), oxidizing a material (e.g., by igniting), volatilizing to cause release of a volatile gas (e.g., by heating a petrochemical or a carbonate material), and/or generating a gas by chemical reaction.

In some embodiments, the pressure generator 136 is a gas generator including a heating element 136A coated with or placed proximate a gas providing material such as potassium permanganate powder. Potassium permanganate is known to react chemically in the presence of heat to release oxygen gas. In some cases, the heating element 136A is disposed in a housing 136B that separates the heating element 136A from portions of the shell 112 and/or the payload 150 that might otherwise be adversely affected by heat. The housing 136B permits the flow of gas through the housing 136B.

Other suitable gas generators for the pressure generator 136 include a gas generator that contains a chemically reactive substance (e.g., an acid, base, salt or water) with a reactive metal, salt, mixture, composition or solution. For example, gas may be provided by mixing a metal such as lithium or a salt such as lithium hydride with water to generate a gas (e.g., hydrogen).

The transducer 138 may include any suitable device or devices to support desired operations of the payload 150. According to some embodiments, the transducer 138 includes a radio or other wireless communication device that can send and/or receive a signal. The received and/or transmitted signals may include data such as a command, program, or update. In some embodiments, the transducer 138 employs a physical connection in place of or additional to a wireless connection.

The transducer 138 may include a transmitter. Examples of suitable transmitters include a radio antenna circuit, an optical source, or a sonar transponder. The transmitter may include an acoustic detector, an acoustic emitter, an optical sensor, an optical emitter, an electromagnetic wave sensor, and/or an electromagnetic wave emitter.

In some cases, the transducer 138 includes a sensor. According to some embodiments, the sensor is adapted to sense a parameter of the container system 100 itself, a parameter external to the container system 100, or an exogenous signal. According to some embodiments, the sensor is adapted to sense a parameter of the water W. According to some embodiments, the sensor includes an acoustic detector, an RF detector, a hydrophone, an optical detector, a camera, and/or an environmental sensor. Detected or transmitted signals may include, for example, radio, magnetic, electric, electromagnetic, mechanical, chemical, optical, and/or environmental signals.

The secondary object 170 (FIGS. 1 and 2) may be an object or structure of any suitable configuration external to the shell 112 that provides a complementary attribute or service to the dispensable unit 101. The secondary object 170 may provide weight to anchor or reduce the buoyancy of the dispensable unit 101. The secondary object 170 may be operable to control, communicate with or signal to or via the dispensable unit 101. According to some embodiments, the secondary object 170 includes a housing 174 defining a seat 174A for the shell 112. An external controller 176 of the secondary object 170 can be operatively connected to the dehiscence module 132 by the link 144. The dehiscence module 132 and the external controller 176 can transmit force, energy and/or signals therebetween via the link 144. In some embodiments, the link 144 is a physical link and the dehiscence module 132 and/or the secondary object include a mechanism to selectively release or sever the link 144. In some embodiments, the link 144 is a wireless radio or magnetic link, e.g., for communications.

The payload 150 (FIG. 2) may be of any suitable type and configuration that is desirably stowed, conveyed or deployed with respect to a submerged location or desirable deployment depth. As discussed above, the payload 150 may in some embodiments include a self-contained unit and, more particularly, may include a self-contained communications device. In some embodiments and as shown in FIG. 2, the payload 150 includes a skin or housing 152 defining an interior chamber 154 and an operational module 160 contained in the chamber 154. The operational module 160 can include a controller 162, a transducer 164, a destructor 166 and a battery 168.

The housing 152 may be of any suitable type capable of providing protection for the contents of the chamber 154 from exposure to water. According to some embodiments, the housing 152 is a flexible skin formed from a plastic or elastic material or film.

The controller 162 may be any suitable device or devices configured to enable the methods discussed herein. The controller 162 may be configured to control, activate, energize, modify or destruct the shell 112, the dehiscing system 130, the link 146, the housing 152, the transducer 164, the destructor 166 and/or the battery 168. The controller 162 may include a processor configured to accept and process a signal such as a command, communication, trigger, alarm, activation or initiation. According to some embodiments, the controller 162 is operatively connected to the dehiscence module 132 by the link 146 to transmit signals therebetween.

The transducer 164 may be connected to the controller 162 and can be configured to send and/or receive a signal. The transducer 164 may include a radio and an associated antenna 164A. The transducer 164 may be configured to modify a signal and may include a conditioner, converter and/or processor for this purpose. The transducer 164 may be capable of sending and/or receiving at least one of an electrical, optical, magnetic, inductive, radio frequency, thermal and mechanical signal.

The destructor 166 is configured to, when activated, render at least a portion of the payload 150 inoperable. In some embodiments, the destructor 166 can be activated to rend or breach the housing 152. In some embodiments, the destructor 166 can be activated to overload the circuits of or destroy the controller 162 and/or the transducer 164.

The battery 168 may be connected to provide power to one or more of the dehiscence module 132, the link 146, the payload housing 152, the controller 162, the transducer 164, and the destructor 166.

The payload delivery system 10 may be constructed by any suitable means. The payload 150 and the dehiscence module 132 are positioned in the shell members 114, 116 and a suitable seal is effected between the shell members 114, 116.

In some cases, payload 150 is sealed in the shell 112 with excess or injected gas, for example at the time of final assembly, to provide an internal pressure greater than zero atmospheres (gauge). In some cases, the shell 112 is assembled at a reduced environmental temperature as means of producing elevated internal pressure in use. For example, the shell 112 can be assembled and sealed while inside an assembly apparatus operated at between 0 and 20 atmospheres (gauge). In use, the increased internal pressure can cause or assist in separation of the shell members 114, 116 to dehisce the container 110. In some embodiments, the pressure generator 136 can be omitted or remain unactivated, and the container 110 is dehisced by the elevated positive pressure in the chamber 120 when said chamber pressure exceeds the external pressure imposed by the water W and the resistance to dehiscing presented by the seal.

In some cases, the payload 150 is sealed in the shell 112 at a reduced atmospheric pressure or an elevated environmental temperature as means of producing reduced or sub-atmospheric internal pressure in use. In use, the reduced internal pressure can prevent or inhibit separation of the shell members 114, 116 until actuation of the dehiscing system 130 to dehisce the container 110.

The payload delivery system 10 can be used to contain and protect the payload 150 in the chamber 120 until a desired or prescribed event or condition occurs, whereupon the dehiscing system 130 will cause the shell members 114, 116 to dehisce and release the payload 150 from the chamber 120. In this manner, the payload 150 can be protected from the surrounding fluid, temperature, pressure, harmful signals or other environmental conditions that may damage or compromise the payload 150. The dehiscing system 130 may cause the container 110 to dehisce using a suitable actuator automatically in response to the desired or prescribed event or condition.

The prescribed event or condition that triggers the dehiscing system 130 to initiate dehiscence of the container 110 may depend on the nature of the deployment, the nature and characteristics of the payload 150, the intended operations, and other structural and operational factors and attributes. According to some embodiments, the container 110 is dehisced responsive to a prescribed event including at least one of elapse of a prescribed period of time, achievement or attainment of a prescribed depth, detection of a prescribed signal, receipt of a command, attainment of a prescribed location, and occurrence of a prescribed operational condition. According to some embodiments, the container 110 is dehisced when an externally imposed pressure on the container 110 (e.g., water pressure) becomes less that a prescribed threshold pressure.

The container 110 may be dehisced by the dehiscing system 130 using any suitable mechanism to generate an outward force capable of dehiscing the container 110. In some embodiments, this outward force may be generated mechanically or electrically, for example, by melting, as discussed below with regard to further embodiments of the present invention. In some embodiments, the outward force is provided by generating increased gas pressure within the chamber 120 with respect to external pressure that forces the shell members 114, 116 apart. The increased gas pressure can be generated by heating an existing gas in the chamber 120 and/or generating additional gas as discussed above (e.g., with reference to the pressure generator 136). In embodiments wherein the container 110 is manufactured to have an internal pressure that is negative (i.e., sub-atmospheric), the dehiscing system 130 may generate sufficient additional internal pressure to both offset or compensate for the negative initial internal pressure and to exceed the external pressure at the selected depth in an amount sufficient to overcome the seal between the shell members 114, 116. In embodiments wherein the container 110 is manufactured to have an internal pressure that is positive (i.e., greater than atmospheric), the requirement for additional pressure may be reduced by a corresponding amount.

The payload delivery system 10 may be initially deployed in any suitable location and manner. For example, the payload delivery system 10 may be mounted on a vehicle (e.g., an unmanned underwater vehicle (UUV)), a platform, or the substratum G, or may float neutrally buoyantly between the substratum G and the surface WS of the water. Once deployed, the payload delivery system 10 may hold the dispensable unit 101 (i.e., the container 120, the dehiscence module 130, and the payload 150) and subsequently release the dispensable unit 101 from the secondary object 170 responsive to the occurrence of a prescribed event, time or environmental condition. According to some embodiments, the dispensable unit 101 is automatically released from the secondary object 170 responsive to the triggering event or condition. According to some embodiments, the dispensable unit 101 is released responsive to a prescribed event including at least one of elapse of a prescribed period of time, achievement or attainment of a prescribed depth, detection of a prescribed signal, receipt of a command, attainment of a prescribed location, and occurrence of a prescribed operational condition. Once released, the dispensable unit 101 will buoyantly ascend in the water W.

The dehiscence module 132 may initiate the generation of increased internal pressure or such other step(s) as needed to dehisce the container 110 before, during or after release of the dispensable unit 101 from the secondary object 170. The dehiscence module 132 may be triggered to initiate dehiscence by the same triggering event or condition that triggers the release of the dispensable unit 101, or may be triggered by a different event/condition. For example, the dehiscence module 130 may cause the container 110 to dehisce a prescribed number of seconds after release from the secondary object 170. By way of further example, the dehiscence module 130 may cause the container 110 to dehisce when the external pressure becomes less than a prescribed threshold pressure. By way of further example, the dehiscence module 132 may cause the container 110 to dehisce only when the dispensable unit 101 receives a command, such as by wireless signal from a remote device (e.g., the device 15 of FIG. 5B).

An exemplary deployment and use of the payload delivery system 10 in accordance with embodiments of the present invention will now be described with reference to FIGS. 5A and 5B. The payload delivery system 10 is placed on the substratum G, thereby positioning the dispensable unit 101 at a first, relatively deep depth $D_1$ as shown in FIG. 5A. As such, the dispensable unit 10 is subjected to a relatively high water pressure from which the payload 150 is protected by the container 110. The dispensable unit 101 may remain in this position for some definite or indefinite period of time. During this time, the controllers 134, 162, 176, transducers 138, 164 or other components of the secondary object 170, the dehiscing system 130 and/or the payload 150 may monitor the environment, await commands or signals, process received or acquired data, or the like.

The dispensable unit 101 is thereafter released from the secondary object 170. This may be accomplished by severing or otherwise ceasing the link 144 or otherwise decoupling the container 110 from the secondary object 170. The release of the dispensable unit 101 from the secondary object may be triggered by an event or condition as discussed above. For example, the external controller 176 of the secondary object 170 or the controller 134 may be commanded to sever the link 144 by transmitting a wireless signal thereto or by altering a magnetic field with respect to a magnetic reed switch. Once released, the dispensable unit 101 then buoyantly rises due to its own net buoyancy as shown in FIG. 5A in dashed lines to a second depth $D_2$ and beyond.

The dispensable unit 101 may continue to buoyantly rise to lesser depths (e.g., a shallower depth $D_2$ as indicated in FIG. 5A) without yet being dehisced. After the dispensable unit 101 has risen to a third, relatively shallower depth $D_3$, the dehiscence module 132 dehisces the container 110 to expose the contents of the chamber 120 and thereby release the payload 150 from the shell 112 as shown in FIGS. 4 and 5B. The dehiscence of the container 110 may be triggered by any suitable and desired event or condition such as described above. As illustrated, the third depth $D_3$ is located below the water surface WS. However, dehiscence may be delayed until the dispensable unit 101 is at the water surface WS or above the water surface (e.g., floating in the air A).

In order to support initiation, coordination and/or execution of the steps of releasing the dispensable unit 101 and dehiscing the container 110, the external controller 176, the payload controller 162, and/or the dehiscence module controller 134 may conduct appropriate processing and sense associated parameters. According to some embodiments, one or more of these controllers determine a depth of the dispensable unit 101, determine a location of the dispensable unit 101, and/or determine an operational condition of the container 110 or the payload 150.

Deployment of the dispensable unit 101 may further include activating operation of one or more components of the payload 150 and/or the dehiscence module 132, such as the controller 134, the transducer 138, the controller 162 or transducer 164. For example, when the release and dehiscing procedure is initiated, the dehiscence module 132 may automatically activate the controller 162 or the transducer 164.

In some embodiments, the dehiscence module 132 transfers signals or the results of processing to the payload 150 for use in the operation of the payload 150.

The link 144 between the secondary object 170 and the dehiscence module 132 may be used to transmit energy, commands and/or data between the secondary object 170 and the dehiscence module 132. The link 146 between the dehiscence module 132 and the payload 150 can be used to transmit energy, commands and/or data between the dehiscence module 132 and the payload.

The payload delivery system 10 may also send an activation confirmation to an external object, such as a secondary container, dispenser, operator console, or other operational object. Such an activation confirmation may be sent by the secondary object controller 176, the dehiscence module controller 132, and/or the payload controller 162, for example. The activation confirmation may include a confirmation that the dispensable unit 101 has been released from the secondary object 170, that the container 110 has been dehisced, that the dehiscence procedure has been initiated, and/or that a component or components of the payload have been activated.

The payload delivery system 10 may also send an informational signal to an external object, such as a secondary container, dispenser, operator console, or other operational object. The informational signal may indicate the condition of the container system 100 and/or the condition or status of the payload 150.

The payload delivery system 10 may also send or receive operational signals to/from an external object, such as a secondary container, dispenser, operator console, or other operational object. Operational signals may embody, for example, relayed messages, environmental conditions, events, etc. For example, an external object can transmit to the payload 150 signals that are desirably broadcast or operational instructions that determine operation of the payload 150, such as duration and strength of transducer emission and destruction of the housing 152, controller 162 or other payload component.

In some cases, the shell members 114, 116 are scuttled, such as by sinking following release of payload 150. In some cases, a link is maintained between the payload 150 and a shell member 114, 116 or other shell component, which linked portion of the shell 112 is negatively buoyant and acts as a sea anchor to reduce motion of the payload 150 floating on the water surface WS.

Figure 6:
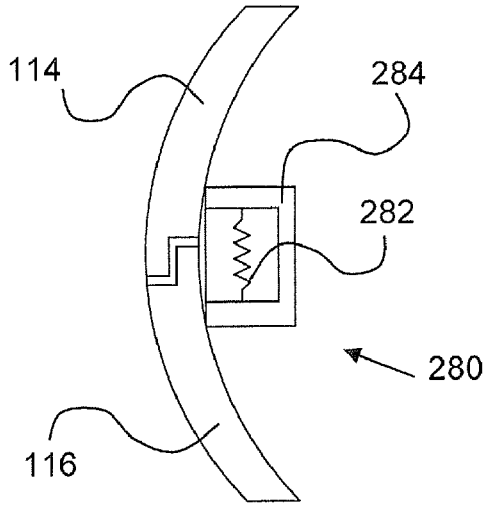
FIGS. 6-8 are schematic, fragmentary, cross-sectional views of the payload delivery system of FIG. 1 including supplemental or alternative dehiscence actuators.

In some embodiments, the seal between the shell members 114, 116 may be configured, released or actively modified to facilitate dehiscing of the container 110 and/or reliable separation of the shell members 114, 116. In some embodiments, a mechanical force actuator may be used in place of or in addition to (i.e., supplemental) a pressure generator (e.g., the pressure generator 136). For example, with reference to FIG. 6, a dehiscence actuator system 280 according to further embodiments of the present invention includes a pusher 282 in the form of a spring and a retainer 284 in the form of a wire. The retainer 284 resists decompression of the pusher 282 until the dehiscing operation is triggered, whereupon the retainer 284 is several and thereby releases the pusher 282. The released spring 282 then mechanically urges the shell members 114, 116 apart. The dehiscing system 130 can dislodge or sever the retainer 284 in any suitable manner to release the spring 282. For example, a mechanism can be provided to displace, release, extend, elongate, severe, melt or decouple the retainer 284. The pusher 282 and the retainer 284 can be mounted on the inside or the outside of the shell 112. Other suitable retainers may include retaining magnets, a ring, a clip, a strap, or a closefitting device such as secondary container or dispenser.

Figure 7:
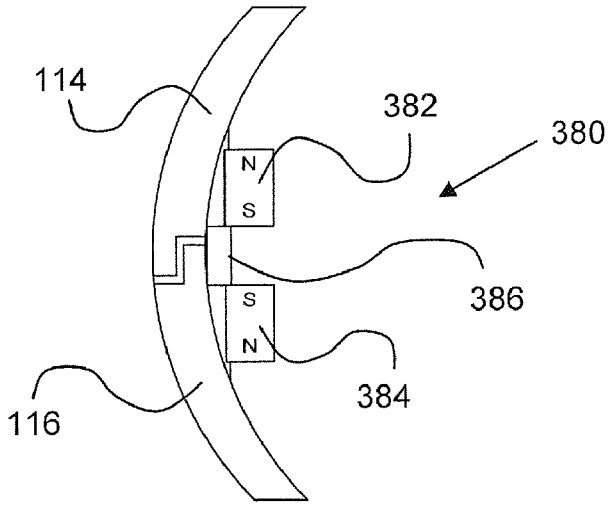

With reference to FIG. 7, a magnetic dehiscing actuator system 380 according to further embodiments of the present invention is shown therein and includes a pair of opposed magnets 382, 384 and a retainer 386. The magnets 382, 384 repel one another and cooperatively function as a pusher to exert a separation force on the shell members 114, 116. The dehiscing system 130 can dislodge or sever the retainer 386 in any suitable manner to release the magnets 382, 384 and thereby permit the magnet repulsion to force the shell members 114, 116 apart. The magnets 382, 384 can be permanent, semi-permanent, inducible and/or electromagnetic. In some cases, the retainer can be omitted.

Figure 8:
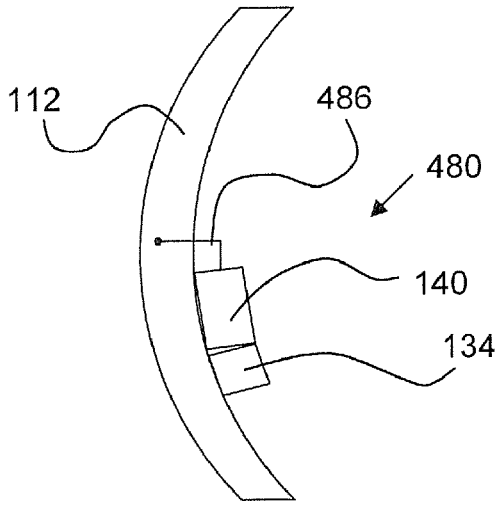

The dehiscing system may include a melter dehiscing component that can melt an opening through the shell 112. With reference to FIG. 8, a melting dehiscing actuator system 480 according to further embodiments of the present invention includes a controller (e.g., the controller 134), a destructor (e.g., the destructor 140) and a heating wire 486. A portion of the heating wire 486 is embedded in the shell 112. According to some embodiments, the shell 112 has a melting point between about 50 and 500 degrees centigrade and the heating wire 486 can generate a temperature in excess of the melting point. The heating wire 486 can be embedded in the shell 112 at the shell member interface flanges 114C, 116C, the seal member 118, and/or in a shell member 114, 116, for example.

Figure 9:
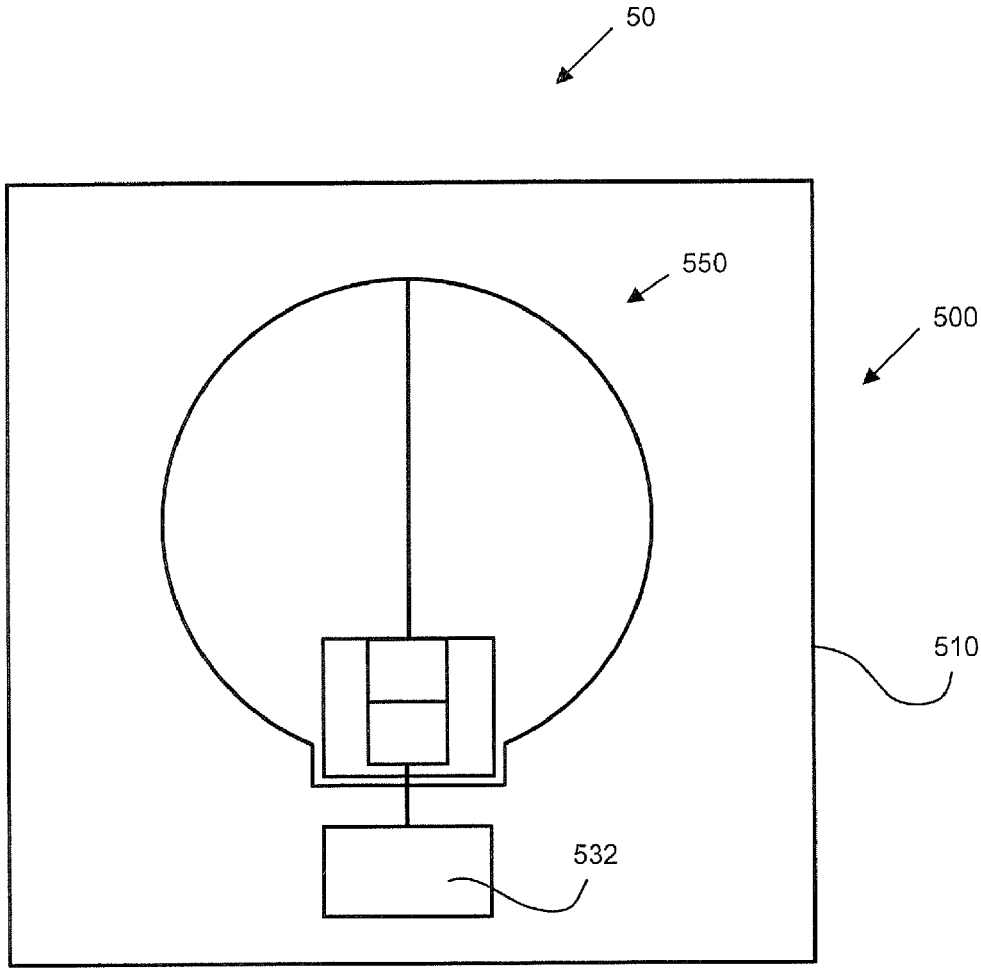
FIG. 9 is a schematic, side view of a payload delivery system according to further embodiments of the present invention.

With reference to FIG. 9, a payload delivery system 50 according to further embodiments of the present invention is shown therein. The payload delivery system 50 includes a container system 500 and a payload 550. The payload 550 may correspond to the payload 150, for example. The container system 50 includes a dehiscence module 532, which may correspond to the dehiscence module 532, and a compliant envelope housing 510. The housing 510 may be formed of a flexible polymeric film sealed against water to protect the payload 550. The housing 510 can be opened by the dehiscence module 532 as described above. According to some embodiments, the dehiscence module 532 includes a melter element to melt an opening in the housing 510.

As discussed above, the payload 150 may be the communications device adapted to float on the surface of the water or in the air. According to some embodiments, the payload 150 is deployed from an underwater location and passively floats to the water surface or above. From the floating location, the payload 150 sends and/or receives wireless communications signals to/from a remote device. The payload 150 may communicate with the remote device using electromagnetic, electrical, magnetic, optical, and/or acoustic signals. The payload 150 may also communicate (e.g., acoustically, optically, or magnetic inductively) with a remote device from an underwater location.

According to some embodiments, the payload 150 communicates with a remote device that is at least one of proximate the sea surface, in the air or on land using RF, optical, or acoustic signals. For example, according to some embodiments, the remote device is an apparatus or station other than the apparatus or station that deployed the payload 150, such as the remote apparatus 15 (FIG. 5B; e.g., a satellite).

The communications between the payload 150 and the remote device may be one-way or two-way. For example, according to some embodiments, the payload 150 receives signals from an underwater device and forwards these signals to a device outside of the water such as the remote apparatus 15. Alternatively or additionally, the payload 150 receives signals from a device outside of the water such as the remote apparatus 15 and forwards these signals to an underwater device. In some such embodiments, the communications between the payload 150 and the remote underwater device are accomplished via acoustic signals and the communications between the payload 150 and the remote device outside the water are accomplished via RF signals.

According to some embodiments, the payload 150 rises towards or to the surface of the water to obtain information or data that may include: environmental parameters, geo-location coordinates, command and control signals, and/or mission updates, and communicates such data to an underwater device such as a monitoring station or vehicle. In some embodiments, the payload 150 wirelessly communicates such information to the submerged device.

In some embodiments, the payload 150 sends signals to the remote device including at least one of: a signal detected from another source; a signal from another source that has been processed by the payload 150; information related to the operation or status of the payload 150 itself; an environmental parameter sensed by the payload 150; a forwarded message from another source; an identifier of the payload 150; the current time; the current date; and the location of the payload 150. The payload 150 may transmit a message containing at least one of: an identifier of the payload 150; the time a signal or parameter was detected by the payload 150; a location; a raw signal; a signature; a classification; identification; and an estimate of a range or direction to a source of a signal.

According to some embodiments, the payload 150 senses an environmental parameter and/or communicates with a remote device while the payload 150 is floating submerged in the water, proximate the water surface, or above the water surface.

In some cases, the payload 150 is released to float to the surface and emit at least one of: an acoustic, optical, or electromagnetic signal. In some embodiments, the payload 150 is interrogated or commanded by another device to emit a communications signal.

In some cases, the payload 150 operates in response to a prescribed lapse of time or arrival of a prescribed time. For example, the payload 150 may begin emitting communications signals or "wake up" to receive communications signals at a pre-programmed time. In some cases, the payload 150 operates in response to a detected signal (e.g., an interrogation or command signal).

In some cases, the payload 150 operates in response to a detected event such as a received signal or an environmental event. In an illustrative use, the payload 150 or the secondary object 170 acoustically detects a passing vessel, for example, by detecting an engine noise from the vessel. According to some embodiments, the payload 150 sends notification of the detected vessel to a remote receiver. In some cases, the notification includes additional data such as an identifier of the payload 150, a signal classification, the location where the detection occurred, and/or the time of the detection. Other environmental events that may trigger the payload 150 to communicate may include, for example, seismic activity, a tsunami, a storm, or any other event detectable by the payload 150.

According to some embodiments, the payload 150 while submerged senses an environmental parameter (e.g., a parameter of the water) and thereafter the dispensable unit 101 is released and dehisced to permit the payload 150 to float to the water surface or into the air to communicate the sensed data to a remote device.

An illustrative method of using the payload 150 includes sampling water parameters to characterize a sound velocity profile. Further methods of use may include characterizing or profiling water movement, electrical conductivity of the water, water temperature, depth in the water, light intensity, turbidity, chlorophyll concentration in the water, dissolved oxygen concentration in the water, pH of the water, or identification of a type or concentration of material in the water including at least one of: organic, inorganic, chemical, biological, radiological, and toxic material.

According to some embodiments, the payload 150 is used to aid navigation, such as by providing a signal for direction finding. In some cases, the signal comprises additional information such as location or identification information. In an illustrative example, the payload 150 is activated to emit sonar.

In some embodiments, the payload 150 is used to receive data and thereafter communicate the received data or modify its operation based on the received data.

According to some embodiments, the payload 150 is a single-use device. According to some embodiments, the payload 150 includes a scuttling system that destroys or sinks the payload 150, at least in part. For example, the payload 150 may include a hot wire, an explosive device, and/or a mechanical device that breaches the housing 152 to permit inflow of water or outflow of a lighter than air gas to cause the payload 150 to sink in the water or air. The payload 150 may include such a device or an electronic device to destroy a circuit of the payload 150.

While the container 110 has been described herein with reference to submersion in water, it will be appreciated that the container 110 may be submerged in other types of liquid and gas. The container 110 may also be submerged in sediments or other unconsolidated material.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A payload delivery system for protecting and delivering a payload submerged in a submersion medium, the payload delivery system comprising a containment system including:

a container including a pressure-resistant shell defining a sealed containment chamber;

a dehiscing system operative to dehisce the shell to open the containment chamber to the submersion medium responsive to a prescribed event and/or a prescribed environmental condition;

a secondary object operable to retain and selectively release the container; and a link between the dehiscing system and the secondary object to transmit force, energy and/or signals between the dehiscing system and the secondary object.

2. The payload delivery system of claim 1 wherein the dehiscing system is operative to automatically dehisce the shell to open the containment chamber to the submersion medium responsive to the prescribed event and/or the prescribed environmental condition.

3. The payload delivery system of claim 1 wherein the shell includes a plurality of substantially rigid shell members mated to one another to form the sealed containment chamber.

4. The payload delivery system of claim 1 wherein the shell includes a flexible envelope defining the sealed containment chamber.

5. The payload delivery system of claim 1 wherein the dehiscing system is operative to automatically dehisce the shell to open the containment chamber to the submersion medium responsive to a prescribed event.

6. The payload delivery system of claim 5 wherein the prescribed event includes at least one of: elapse of a prescribed period of time; attainment of a prescribed depth; detection of a prescribed signal; receipt of a command; attainment of a prescribed location; and occurrence of a prescribed operational condition.

7. The payload delivery system of claim 6 wherein the prescribed event includes a lapse of a prescribed period of time.

8. The payload delivery system of claim 6 wherein the prescribed event includes attainment of a prescribed depth.

9. The payload delivery system of claim 1 wherein the dehiscing system is operative to automatically dehisce the shell to open the containment chamber to the submersion medium responsive to a prescribed environmental condition.

10. The payload delivery system of claim 9 wherein the prescribed environmental condition includes an external pressure on the shell that is less than a prescribed threshold pressure at a time prior to dehiscence.

11. The payload delivery system of claim 1 wherein the dehiscing system includes a pressure generator operable to generate an increase in pressure in the containment chamber to cause the container to dehisce.

12. The payload delivery system of claim 11 wherein the pressure generator includes a heating element to heat a gas in the containment chamber to increase the pressure in the containment chamber.

13. The payload delivery system of claim 11 wherein the pressure generator includes a gas provider to introduce additional gas into the containment chamber to increase the pressure in the containment chamber.

14. The payload delivery system of claim 1 wherein the dehiscing system includes a mechanical dehiscing actuator including a pusher and a retainer.

15. The payload delivery system of claim 1 wherein the dehiscing system includes a magnet dehiscing actuator including at least one magnet.

16. The payload delivery system of claim 1 wherein the dehiscing system includes a heating element to selectively melt the shell.

17. The payload delivery system of claim 1 including a payload contained in the containment chamber.

18. The payload delivery system of claim 17 wherein the payload includes a substantially rigid payload housing disposed in the containment chamber, wherein the payload housing is releasable when the container is dehisced.

19. The payload delivery system of claim 1 including a link between the dehiscing system and the payload to transmit force, energy and/or signals between the dehiscing system and the payload.

20. The payload delivery system of claim 1 wherein an internal pressure of the containment chamber is sub-atmospheric.

21. The payload delivery system of claim 1 wherein an internal pressure of the containment chamber is greater than atmospheric before the container is dehisced.

22. The payload delivery system of claim 1 wherein the containment system is operative to automatically activate the payload prior to release of the payload.

23. The payload delivery system of claim 1 wherein the containment system is operative to emit a signal confirming activation of the dehiscing system and/or the payload.

24. The payload delivery system of claim 1 wherein the containment system and the payload form a dispensable unit having a buoyancy enabling the dispensable unit to passively ascend in the submersion medium.

25. The payload delivery system of claim 1 including a destructor to selectively destroy a component of at least one of the containment system and the payload.

26. A method for protecting and delivering a payload submerged in a submersion medium, the method comprising:

providing a containment system including:

a container including a pressure-resistant shell defining a sealed containment chamber; and a dehiscing system;

mounting the payload in the containment chamber;

submerging the container with the payload mounted in the containment chamber at a first depth; thereafter permitting the container with the payload mounted in the containment chamber to buoyantly rise to a second depth shallower than the first depth; and automatically dehiscing the shell at the second depth using the dehiscing system to open the containment chamber to the submersion medium responsive to a prescribed event and/or a prescribed environmental condition.

27. The method of claim 26 wherein dehiscing the shell at the second depth using the dehiscing system to open the containment chamber to the submersion medium includes automatically dehiscing the shell using the dehiscing system to open the containment chamber to the submersion medium responsive to the prescribed event and/or the prescribed environmental condition.

28. A payload delivery system for protecting and delivering a payload submerged in a submersion medium, the payload delivery system comprising a containment system including:

a container including a pressure-resistant shell defining a sealed containment chamber; and a dehiscing system operative to dehisce the shell to open the containment chamber to the submersion medium responsive to a prescribed event and/or a prescribed environmental condition;

wherein the dehiscing system includes a pressure generator operable to generate an increase in pressure in the containment chamber to cause the container to dehisce; and wherein the pressure generator includes a heating element to heat a gas in the containment chamber to increase the pressure in the containment chamber.

29. A payload delivery system for protecting and delivering a payload submerged in a submersion medium, the payload delivery system comprising a containment system including:

a container including a pressure-resistant shell defining a sealed containment chamber; and a dehiscing system operative to dehisce the shell to open the containment chamber to the submersion medium responsive to a prescribed event and/or a prescribed environmental condition;

wherein the dehiscing system includes a magnet dehiscing actuator including at least one magnet.

30. A payload delivery system for protecting and delivering a payload submerged in a submersion medium, the payload delivery system comprising a containment system including:

a container including a pressure-resistant shell defining a sealed containment chamber; and a dehiscing system operative to dehisce the shell to open the containment chamber to the submersion medium responsive to a prescribed event and/or a prescribed environmental condition;

wherein the dehiscing system includes a heating element to selectively melt the shell.

31. A payload delivery system for protecting and delivering a payload submerged in a submersion medium, the payload delivery system comprising a containment system including:

a container including a pressure-resistant shell defining a sealed containment chamber;

a dehiscing system operative to dehisce the shell to open the containment chamber to the submersion medium responsive to a prescribed event and/or a prescribed environmental condition; and a link between the dehiscing system and the payload to transmit force, energy and/or signals between the dehiscing system and the payload.

32. A payload delivery system for protecting and delivering a payload submerged in a submersion medium, the payload delivery system comprising a containment system including:

a container including a pressure-resistant shell defining a sealed containment chamber; and a dehiscing system operative to dehisce the shell to open the containment chamber to the submersion medium responsive to a prescribed event and/or a prescribed environmental condition;

wherein the containment system is operative to emit a signal confirming activation of the dehiscing system and/or the payload.

33. A payload delivery system for protecting and delivering a payload submerged in a submersion medium, the payload delivery system comprising a containment system including:

a container including a pressure-resistant shell defining a sealed containment chamber;

a dehiscing system operative to dehisce the shell to open the containment chamber to the submersion medium responsive to a prescribed event and/or a prescribed environmental condition; and a destructor to selectively destroy a component of at least one of the containment system and the payload.

* * * * *